US009567874B2

(12) United States Patent
Prabhu et al.

(10) Patent No.: US 9,567,874 B2
(45) Date of Patent: Feb. 14, 2017

(54) ELECTRIC INDUCTION FLUID HEATERS FOR FLUIDS UTILIZED IN TURBINE-DRIVEN ELECTRIC GENERATOR SYSTEMS

(71) Applicant: Inductotherm Corp., Rancocas, NJ (US)

(72) Inventors: Satyen N. Prabhu, Voorhees, NJ (US); Joseph T. Belsh, Mount Laurel, NJ (US); Mike Maochang Cao, Westampton, NJ (US)

(73) Assignee: INDUCTOTHERM CORP., Rancocas, NJ (US)

( * ) Notice: Subject to any disclaimer, the term of this patent is extended or adjusted under 35 U.S.C. 154(b) by 136 days.

(21) Appl. No.: 14/311,317

(22) Filed: Jun. 22, 2014

(65) Prior Publication Data

US 2014/0373543 A1 Dec. 25, 2014

Related U.S. Application Data

(60) Provisional application No. 61/838,242, filed on Jun. 22, 2013.

(51) Int. Cl.

| | |
|---|---|
| ***F01K 3/00*** | (2006.01) |
| ***F22B 1/28*** | (2006.01) |
| ***F01K 13/00*** | (2006.01) |
| ***F01K 21/00*** | (2006.01) |
| ***F22B 1/30*** | (2006.01) |
| ***F01K 3/18*** | (2006.01) |

(52) U.S. Cl.

CPC ..... *F01K 3/00* (2013.01); *F01K 3/186* (2013.01); *F01K 13/006* (2013.01); *F01K 21/00* (2013.01); *F22B 1/28* (2013.01); *F22B 1/285* (2013.01); *F22B 1/30* (2013.01)

(58) Field of Classification Search

CPC ..... F01K 3/00; F01K 21/00; F01K 13/006; F01K 3/186; F22B 1/30; F22B 1/285; F22B 1/28

USPC ..... 60/670; 122/4 A

See application file for complete search history.

(56) References Cited

U.S. PATENT DOCUMENTS

| | | | | |
|---|---|---|---|---|
| 4,008,762 A * | 2/1977 | Fisher | E21B 43/24 | 166/248 |
| 5,666,891 A * | 9/1997 | Titus | A62D 3/19 | 110/250 |
| 2006/0042251 A1 * | 3/2006 | Villalobos | F22B 3/00 | 60/670 |

(Continued)

FOREIGN PATENT DOCUMENTS

| | | |
|---|---|---|
| JP | 2003-168547 A | 6/2003 |
| JP | 2004-214039 A | 7/2004 |
| JP | 2006-228438 A | 8/2006 |

*Primary Examiner* — Hoang Nguyen

(74) *Attorney, Agent, or Firm* — Philip O. Post

(57) ABSTRACT

A fluid latent heat absorption electric induction heater is provided for raising the temperature of a fluid supplied to a fluid-driven turbine in a turbine-driven electric power generation system. The fluid latent heat absorption electric induction heater alternatively transfers heat to the fluid by induced susceptor heating, or a combination of inductor Joule heating and induced susceptor heating. The fluid may be water-steam for powering a steam-driven turbine or another fluid used in a phase change system for driving a fluid-driven turbine in a turbine-driven electric power generation system.

20 Claims, 4 Drawing Sheets

(56) References Cited

U.S. PATENT DOCUMENTS

| | | | | |
|---|---|---|---|---|
| 2006/0201157 | A1* | 9/2006 | Villalobos | F01K 13/006 60/670 |
| 2008/0171899 | A1* | 7/2008 | Pulkrabek | C10J 3/20 585/240 |
| 2009/0012655 | A1 | 1/2009 | Kienman et al. | |
| 2010/0012293 | A1 | 1/2010 | Sinha et al. | |

* cited by examiner

ELECTRIC INDUCTION FLUID HEATERS FOR FLUIDS UTILIZED IN TURBINE-DRIVEN ELECTRIC GENERATOR SYSTEMS

CROSS REFERENCE TO RELATED APPLICATIONS

This application claims priority to U.S. Provisional Application No. 61/838,242 filed Jun. 22, 2013, hereby incorporated by reference in its entirety.

FIELD OF THE INVENTION

The present invention relates to electric induction heaters for fluids utilized in driving turbines used in turbine-driven electric power generation systems where the fluid is water/steam for steam-driven generators, or other fluids where change state (liquid/vapor) processing is used in the fluid turbine-driven electric power generation system.

BACKGROUND OF THE INVENTION

A simplified steam-driven electric power generation system diagram is illustrated in FIG. 1. Feed pump 102 supplies feed water to boiler 104 where the water is heated and processed to produce superheated steam (in a change state process) that is fed to steam turbine 106. Rotation of the turbine's output shaft 106*a* produces electric power from attached generator 108. The steam that turned turbine 106 is exhausted into condenser 110 where the steam is covered to condensate water and fed to boiler 104 to continue a process that can be based, for example, upon the Rankine cycle.

Boiler 104 typically transfers energy to the supplied water by the chemical reaction of burning some type of fossil fuel. Utility-size steam turbine-driven generators can range in hundreds to thousands of megawatts and require significant quantities of fossil fuels to produce the superheated steam for spinning the steam turbine.

While the working fluid in the Rankine cycle is water, alternative fluids with a liquid-vapor phase change, or boiling point, occurring at temperatures lower than the water-steam phase change can also be used in a turbine-driven electric power generation system in a similar type process. Therefore the terminology "fluid-driven," "fluid liquid state" and "fluid vapor state" is used herein to be inclusive not only of the terms "steam-driven," "water" and "steam," respectively, but also other fluids that could be used in a change state process that may be similar to a Rankine cycle-like process for producing electric power by utilizing a fluid-driven turbine as the prime mover for the electric generator.

Waste heat recovery apparatus can be used to replace some of the functions of a boiler in the above electric power generation system. However such apparatus may require a liquid input with absorbed latent heat that is greater than that normally provided in the system. Thus a source of heat is required to supply the additional latent heat to the liquid.

It is one object of the present invention to provide a fluid latent heat absorption electric induction heater for use in utility-size turbine-driven electric power generation systems without a fossil fuel boiler.

It is another object of the present invention to provide a method of raising the temperature of a fluid used in fluid-driven turbines for utility-size turbine-driven electric power generation systems with a fluid latent heat absorption electric induction heater.

BRIEF SUMMARY OF THE INVENTION

In one aspect the present invention is a fluid latent heat absorption electric induction heater for raising the temperature of a fluid supplied to a fluid-driven turbine in a turbine-driven electric power generation system utilizing water-steam or another fluid where the induction heater transfers a combination of inductor Joule heat and susceptor induced heat to the fluid.

In another aspect the present invention is a fluid latent heat absorption electric induction heater for raising the temperature of a fluid supplied to a fluid-driven turbine in a turbine-driven electric power generation system utilizing water-steam or another fluid where the induction heater transfers susceptor induced heat to the fluid.

In another aspect the present invention is a method of raising the temperature of a fluid in a process for driving a fluid-driven turbine in a turbine-driven electric power generation system with a fluid latent heat absorption electric induction heater by transfer to the fluid a susceptor induced heat, or a combination of inductor Joule heat and susceptor induced heat.

The above and other aspects of the invention are set forth in this specification and the appended claims.

BRIEF DESCRIPTION OF THE DRAWINGS

The appended drawings, as briefly summarized below, are provided for exemplary understanding of the invention, and do not limit the invention as further set forth in this specification and the appended claims.

FIG. 4(*b*) is a cross sectional elevation view of the fluid latent heat absorption electric induction heater in FIG. 4(*a*) through line A-A.

DETAILED DESCRIPTION OF THE INVENTION

Figure 1:
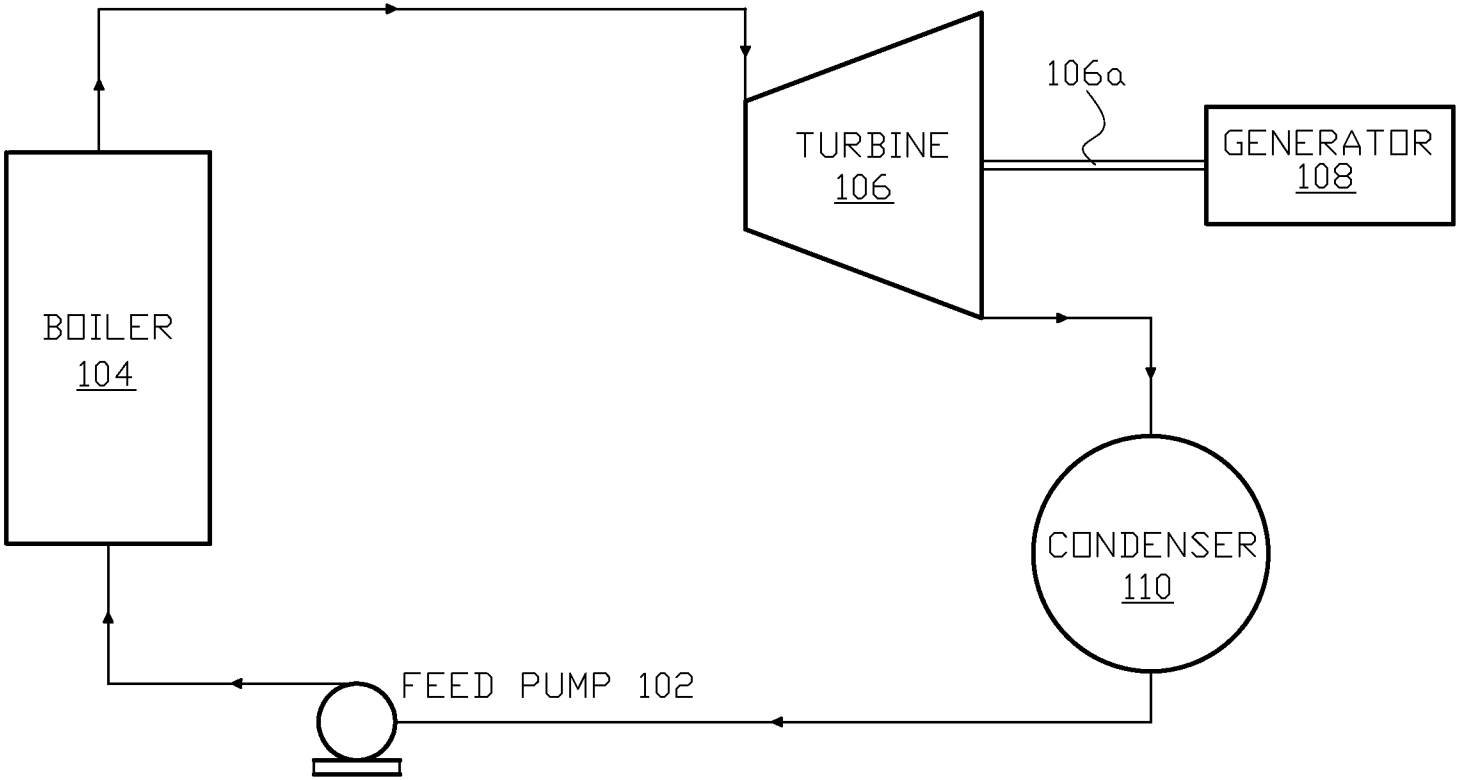
FIG. 1 is a simplified steam-driven electric power generation system diagram.
Figure 2:
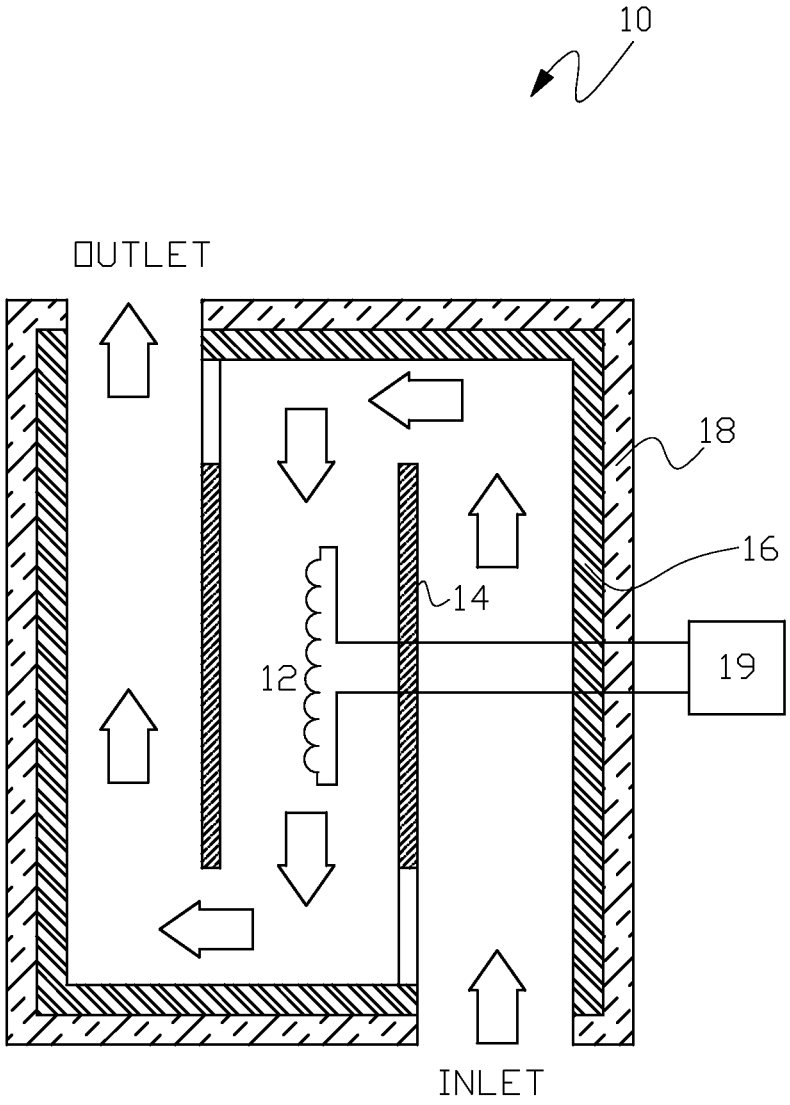
FIG. 2 is a cross sectional view of one example of a fluid latent heat absorption electric induction heater of the present invention for raising the temperature of a fluid supplied to a fluid-driven turbine in a turbine-driven electric power generation system where the induction heater transfers a combination of inductor Joule heat and susceptor induced heat to the fluid.

FIG. 2 illustrates one example of a fluid latent heat absorption electric induction heater 10 of the present invention that raises the temperature of a fluid supplied to a fluid-driven turbine in a turbine-driven electric power generation system. In this embodiment induction heater 10 is a fluid single-pass apparatus comprising at least one inductor 12 disposed within susceptor 14 (shown in single line crosshatch) that is enclosed within containment vessel 16, which may be a pressurized containment vessel optionally surrounded with external thermal insulator 18. Fluid in a low temperature liquid state enters vessel 16 at an inlet opening (INLET) directly or indirectly from a condenser in a fluid-driven utility-size turbine electric generation system without a fossil fuel boiler and makes a single pass through the at least one inductor 12 within susceptor 14 to exit the vessel at a high temperature liquid state at an outlet opening (OUTLET) for fluid change state processing, for example, liquid-vapor state conversion to superheated vapor that turns the fluid-driven turbine.

The at least one inductor 12 is preferably formed from a non-coated electrically conductive material such as, but not limited to, a stainless steel composition to maximize transfer of heat from Joule heating within the at least one inductor to the fluid passing around the at least one inductor. Other types of electrical inductors are used in other embodiments of the invention. In the event that the selected fluid has sufficient electrical conductivity to interfere with performance of the at least one inductor (such as causing electrical shorting of the inductor) or has a corrosive effect on the inductor material, the inductor can be coated with a high temperature-withstand electrical insulation that has high thermal conductivity to maximize heat transfer.

Frequency of the alternating current from one or more power sources 19 to the at least one inductor is selected to produce induced eddy currents within susceptor 14. Power supplied from the one or more power sources can also be selected to optimize Joule heating in the at least one inductor. Heat is transferred to the fluid as it passes through induction heater 10 by conduction from the susceptor wall and convection through the fluid. Thus the liquid state fluid entering vessel 16 at the inlet opening absorbs latent heat from both Joule heating of the at least one inductor and induced susceptor heating as it passes through the interior of the vessel and exits at outlet opening at a raised high temperature liquid state where the high temperature liquid can be fluid-change-state processed, for example, by conversion to superheated vapor that turns the fluid-driven turbine of the turbine-driven generator.

In some examples of the invention, the at least one inductor can be formed in the shape of an induction coil or otherwise configured, such as an assembly of electrically interconnected electrically conductive (for example, stainless steel) rods or pipes that can be spaced apart from each other to maximize heat transfer from the at least one inductor's Joule heating by providing a series of assembly fluid passages between the spaced-apart rod or pipes. In other embodiments of the invention the at least one inductor can be formed from a plurality of electrically interconnected tubular electrical conductors (for example, stainless steel) where at least one of the tubular electrical conductors has a hollow interior that forms a fluid flow passage to maximize time rate of Joule heating transfer.

Susceptor 14 in the above example of the invention is in the shape of an open right cylinder to form an interior fluid passage, and the shape of vessel 16 may also be in the shape of a cylinder with inlet and outlet openings disposed on opposing ends of the vessel. In other examples of the invention the susceptor may be provided in other forms and/or multiple discrete shapes such as multiple susceptor rods, pipes or plates with the susceptor(s) arranged to couple with magnetic flux generated when alternating current flows through the at least one inductor to provide the combination of susceptor heating and Joule heating for absorption of latent heat by the fluid. A susceptor pipes may also have a hollow interior that forms a fluid passage for the fluid.

In the above example of the invention the fluid passage within vessel 16 is a two-turn serpentine path as indicated by the arrows in FIG. 2 with the inlet opening and the outlet opening located at opposing ends of the vessel, and a single pass through the interior fluid passage (and the at least one inductor) formed at least in part by susceptor 14. In other examples of the invention different internal paths with different multiple susceptors and/or the at least one inductors can be provided; for example any number of multi-turn paths, serpentine or otherwise, are provided.

Figure 3:
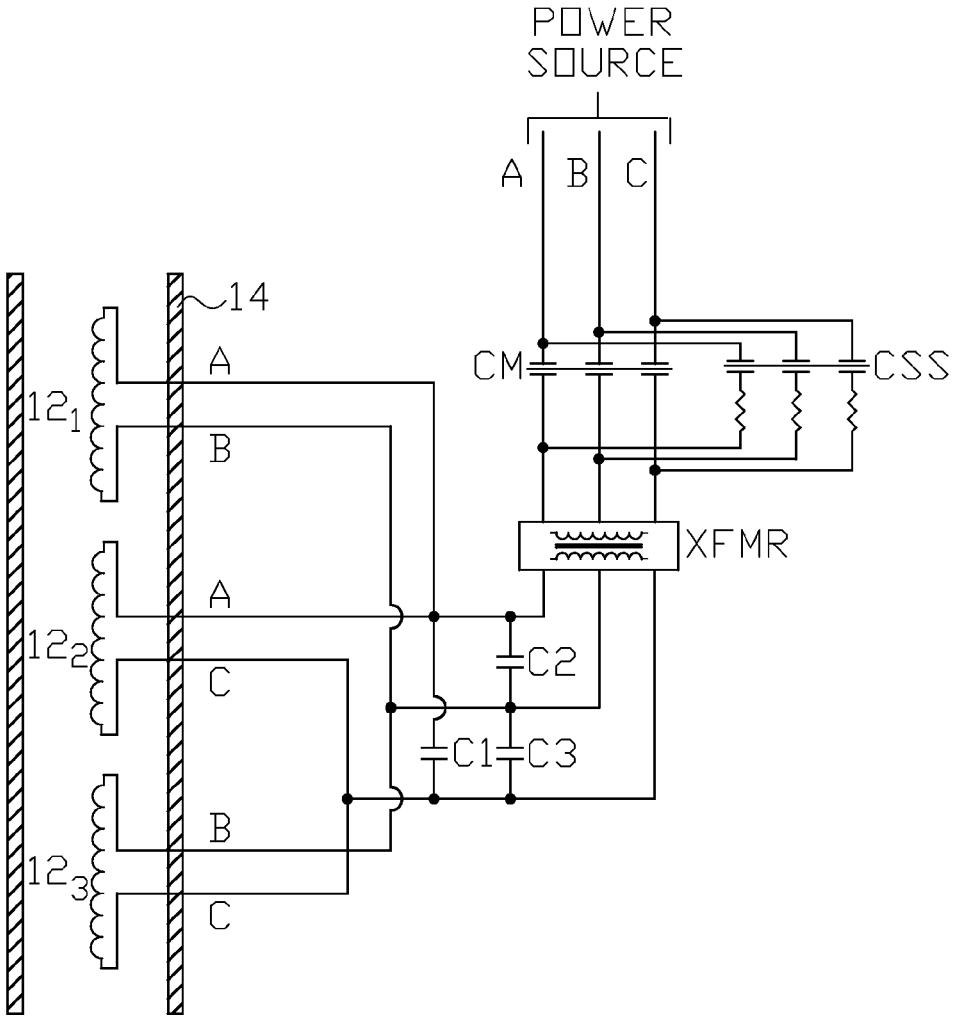
FIG. 3 is a simplified schematic diagram of one example for the supply of electric power to the fluid latent heat absorption electric induction heater shown in FIG. 2.

FIG. 3 illustrates one example of supplying electric power to the at least one inductor when the at least one inductor comprises any multiple of electrically discrete inductors, which in this example is three inductors $\mathbf{12}_1$, $\mathbf{12}_2$ and $\mathbf{12}_3$. The power source supplied from "POWER SOURCE" in FIG. 3 can be from any suitable supply. For example when the turbine-driven generator in the electric power generation system in which the fluid latent heat absorption electric induction heater is used is not providing steady state electric power output from the turbine-driven generator, the supplied power source can be from a separate utility power line or a free standing auxiliary generator set such as a gas turbine-driven generator, and when the turbine-driven generator is in steady state electric power output mode, the supplied power source can be from the output of the turbine-driven generator either directly or after transformation (via transformer XFMR) to a suitable frequency, voltage magnitude and/or number of phases. Preferably the arrangement of susceptor 14 and the at least one inductor 12 is selected for an optimum frequency to induce eddy currents in the susceptor. In the one example of electric supply shown in FIG. 3 a three phase source (A, B and C) is indicated with three phase main line contactor CM paralleled with soft start contactors CSS to limit supply line inductor inrush currents at start up. Contactors C1, C2 and C3 are provided to control the magnitude of supplied power to one or more of the three inductors, which supplied power magnitude is related to the time rate absorption of latent heat by the fluid passing through the induction heater and must be controlled depending on process parameters such as the temperature of the fluid at the outlet opening and fluid flow rate through the vessel. Therefore a power source power output controller can be provided for output power (and/or current) control responsive to the temperature of the high temperature liquid state at the induction heater's outlet opening and/or the fluid flow rate through the vessel.

In other embodiments of the invention, other single or multiple inductors are provided with power sources arranged different from the arrangement shown in FIG. 3.

Figure 4A:
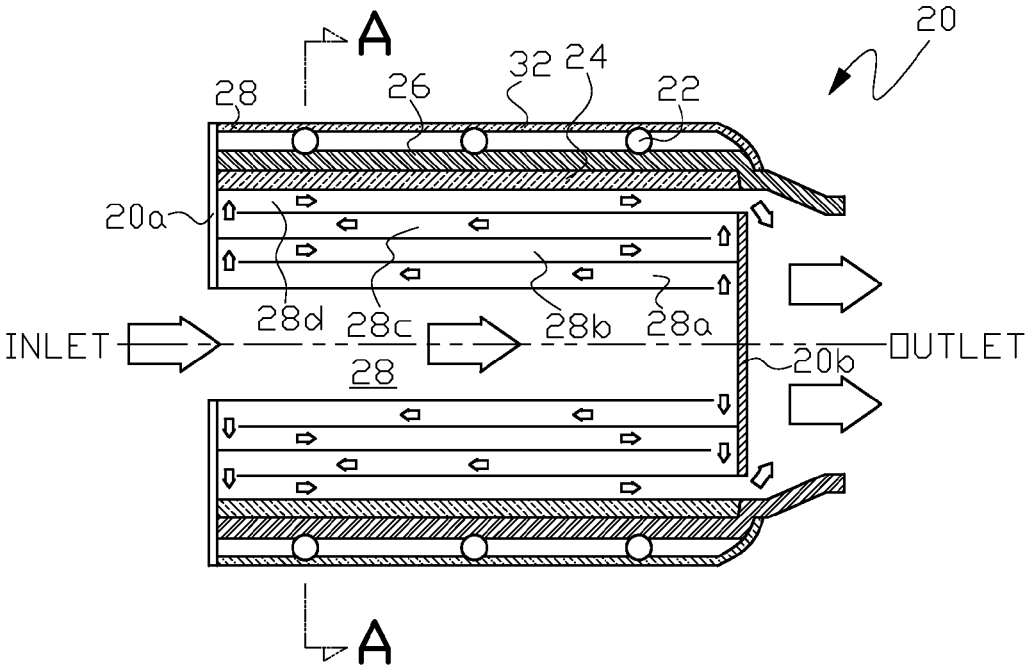
FIG. 4(*a*) is a cross sectional side elevation view of another example of a fluid latent heat absorption electric induction heater of the present invention for raising the temperature of a fluid supplied to a fluid-driven turbine in a turbine-driven electric power generation system where the induction heater transfers susceptor induced heat to the fluid.
Figure 4B:
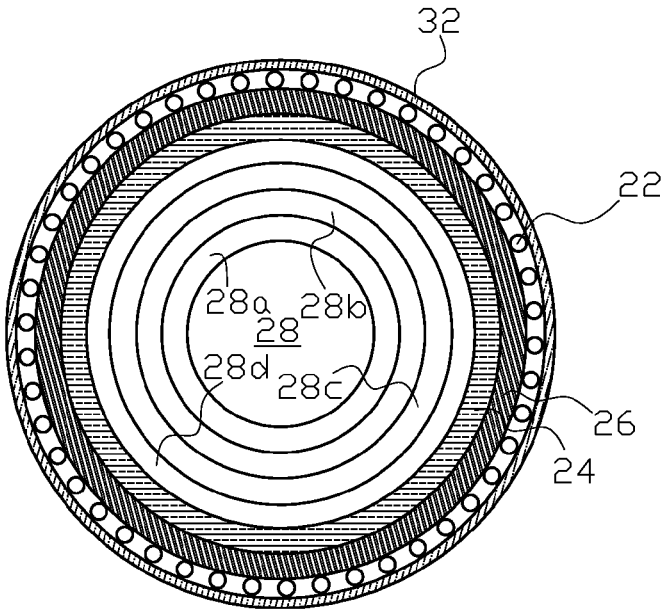

FIG. 4(*a*) and FIG. 4(*b*) illustrate another example of a fluid latent heat absorption electric induction heater 20 of the present invention in which induced susceptor heating is used to transfer latent heat to a fluid supplied to a fluid-driven turbine in a turbine-driven electric power generation system. In this example at least one inductor 22 is disposed around the outside perimeter of vessel 26 that can be a pressurized vessel. Thermal insulator 32 can be provided around the outer perimeter of the at least one inductor. The at least one inductor 22 can be similar to an inductor used in an electric induction furnace in some embodiments of the invention. Susceptor 24 is disposed around the longitudinal inner wall of the vessel.

Induction heater 20 is a multi-channel fluid apparatus with fluid in a low temperature liquid state entering vessel 26 at inlet opening (INLET), for example, directly or indirectly from a condenser in a fluid-driven utility-size turbine electric generation system without a fossil fuel boiler. The inlet opening in this example is disposed in entry end wall 20*a* of the vessel and is axially oriented along the length of the vessel and in fluid communication with central entry fluid passage 28 that extends longitudinally from the fluid inlet opening to the interior of fluid diverter wall 20*b*. A plurality of interior annular fluid flow channels 28*a*, 28*b* and 28*c* are disposed radially around the central entry fluid passage and arranged to move the fluid from the central entry fluid passage in a longitudinal serpentine flow path between the interior of fluid diverter wall 20*b* and the interior of entry end wall 20*a* to an outer annual fluid flow channel 28*d* adjacent to the susceptor. As shown by the flow arrows in FIG. 4(*a*) through interior annular fluid flow channels 28*a*, 28*b* and 28*c*, the flow channels are fluidly interconnected either at the channel's end at the interior of the entry end wall or the interior of the fluid diverter wall in what can be defined as an "opposing-end-interconnected" arrangement that establishes the radially oriented serpentine flow path. An outlet plenum (OUTLET) is in fluid communication with the outer annual fluid flow channel and is located adjacent to the exterior of fluid diverter wall 20*b* to provide an outlet supply of the fluid in a high temperature liquid state for conversion to a superheated vapor to drive the fluid-driven turbine. The number of interior annular flow channels in a particular embodiment of the invention can vary depending upon a particular application.

Frequency of the alternating current from one or more power sources connected to the at least one inductor 22 is selected to produce induced eddy currents in the wall of susceptor 24. Induced susceptor heat is transferred to the fluid as it passes through induction heater 20 first by convection in the annular fluid flow channels and then by conduction when the fluid makes contact adjacent to the susceptor wall in the outer annual fluid flow channel before exiting the vessel at the outlet plenum. Thus in this embodiment of the invention the liquid state fluid entering vessel 26 at inlet opening absorbs latent heat from induced susceptor heating as it passes sequentially through the central entry fluid passage; the multiple annular fluid flow channels; and the outer annular fluid flow channel.

Susceptor 24 in the above example of the invention is in the form of an open right cylinder. Vessel 26 may also be in the shape of a cylinder with the inlet opening and the outlet plenum (opening) located at opposing ends of the vessel. In other examples of the invention the susceptor may be provided in other forms and/or multiple discrete shapes such as rods, pipes or plates as long as the susceptor(s) are arranged to couple with magnetic flux generated when alternating current flows through the at least one inductor.

Supply of electric power to the at least one inductor 22 used in the fluid latent heat absorption electric induction heater 20 shown in FIG. 4(*a*) and FIG. 4(*b*) can be similar to that described in FIG. 3 with appropriate modifications, or otherwise configured.

Where the fluid used is water a fluid latent heat absorption electric induction heater of the present invention can typically raise the absorbed latent heat of the water approximately 100° F. from an inlet opening to an outlet opening of the induction heater in the range of 400-450° F. inlet liquid temperature (low temperature liquid state) to 500-550° F. outlet liquid temperature (high temperature liquid state) in a utility-size steam turbine driven electric power generator system with a fluid latent heat absorption electric induction heater input electric power of multiple megawatts.

In the description above, for the purposes of explanation, numerous specific requirements and several specific details have been set forth in order to provide a thorough understanding of the example and embodiments. It will be apparent however, to one skilled in the art, that one or more other examples or embodiments may be practiced without some of these specific details. The particular embodiments described are not provided to limit the invention but to illustrate it.

Reference throughout this specification to "one example or embodiment," "an example or embodiment," "one or more examples or embodiments," or "different example or embodiments," for example, means that a particular feature may be included in the practice of the invention. In the description various features are sometimes grouped together in a single example, embodiment, figure, or description thereof for the purpose of streamlining the disclosure and aiding in the understanding of various inventive aspects.

The present invention has been described in terms of preferred examples and embodiments. Equivalents, alternatives and modifications, aside from those expressly stated, are possible and within the scope of the invention. Those skilled in the art, having the benefit of the teachings of this specification, may make modifications thereto without departing from the scope of the invention.

The invention claimed is:

1. A fluid latent heat absorption electric induction heater for raising the temperature of a fluid supplied to a fluid-driven turbine in a turbine-driven electric power generation system, the fluid latent heat absorption electric induction heater comprising:

a containment vessel;

at least one susceptor disposed within the containment vessel, the at least one susceptor having an interior fluid passage;

at least one inductor disposed within the interior fluid passage;

an inlet opening in the containment vessel for an inlet supply of the fluid in a low temperature liquid state to the interior fluid passage; and an outlet opening in the containment vessel for an outlet supply of the fluid in a high temperature liquid state for fluid change state processing to drive the fluid-driven turbine.

2. The fluid latent heat absorption electric induction heater of claim 1 wherein the interior fluid passage is disposed within an at least two-turn serpentine fluid passage within the containment vessel between the inlet opening and the outlet opening, the inlet opening disposed in an inlet end of the containment vessel opposite the outlet opening of the containment vessel.

3. The fluid latent heat absorption electric induction heater of claim 1 wherein the at least one inductor is formed from an uncoated electrically conductive material.

4. The fluid latent heat absorption electric induction heater of claim 1 wherein the at least one inductor is formed from an electrically conductive material coated with a high temperature-withstand electrical insulation having a high thermal conductivity.

5. The fluid latent heat absorption electric induction heater of claim 1 wherein the at least one inductor is formed from an assembly of electrically interconnected and spaced-apart electrically conductive rods or pipes to provide a plurality of inductor fluid passages through the assembly.

6. The fluid latent heat absorption electric induction heater of claim 1 wherein the at least one inductor is formed from at least one induction coil and an assembly of electrically interconnected and spaced-apart electrically conductive rods or pipes to provide a plurality of inductor fluid passages through the assembly.

7. The fluid latent heat absorption electric induction heater of claim 1 wherein the at least one inductor is formed from a plurality of electrically interconnected tubular electrical conductors, at least one of the electrically interconnected tubular electrical conductors having a hollow interior, the hollow interior forming an inductor fluid passage.

8. The fluid latent heat absorption electric induction heater of claim 1 wherein the at least one susceptor comprises a plurality of susceptor rods.

9. The fluid latent heat absorption electric induction heater of claim 1 wherein the at least one susceptor comprises a plurality of susceptor pipes, at least one of the plurality of susceptor pipes having a hollow interior, the hollow interior forming a susceptor fluid passage.

10. The fluid latent heat absorption electric induction heater of claim 1 further comprising one or more alternating current power sources having a power source output connected to the at least one inductor, the power source output having a susceptor eddy current frequency to induce eddy currents in the at least one susceptor.

11. The fluid latent heat absorption electric induction heater of claim 10 wherein the one or more alternating current power sources comprises a generator output of an electric generator powered by the fluid-driven turbine.

12. The fluid later heat absorption electric induction heater of claim 10 further comprising an output power controller for controlling the power source output responsive to the temperature of the high temperature liquid state at the outlet opening and/or the flow rate of the fluid passing through the fluid latent heat absorption electric induction heater.

13. A method of raising the temperature of a fluid in a process for driving a fluid-driven turbine in a turbine-driven electric power generation system with a fluid latent heat absorption electric induction heater, the method comprising:

supplying the fluid at a low temperature liquid state to an inlet of the fluid latent heat absorption electric induction heater;

passing the fluid through at least one interior fluid passage within the fluid latent heat absorption electric induction heater, the at least one interior fluid passage formed at least in part from one or more susceptors and having at least one inductor disposed within the at least one interior fluid passage;

supplying an alternating current to the at least one inductor at a susceptor heating frequency to induce eddy current heating in the one or more susceptors;

transferring Joule heat from the at least one electric inductor to the fluid passing through the at least one interior fluid passage;

transferring susceptor eddy current heat from the one or more susceptors to the fluid passing through the at least one interior fluid passage; and supplying the fluid at a high temperature liquid state to an outlet of the fluid latent heat absorption electric induction heater for fluid change state processing to drive the fluid-driven turbine.

14. The method of claim 13 further comprising controlling the supply of the alternating current to the at least one inductor responsive to the temperature of the high temperature liquid state at the outlet opening and/or the flow rate of the fluid passing through the fluid latent heat absorption electric induction heater.

15. The method of claim 13 wherein the at least one inductor comprises an assembly of electrically interconnected and spaced-apart electrically conductive rods or pipes, the method further comprising passing the fluid through the assembly of electrically interconnected and spaced-apart electrically conductive rods or pipes.

16. The method of claim 13 wherein the at least on inductor comprises a plurality of electrically interconnected tubular electrical conductors, at least one of the plurality of electrically interconnected tubular electrical conductors having a hollow interior, the method further comprising passing the fluid through the hollow interior of the at least one of the plurality of electrically interconnected tubular electrical conductors.

17. A fluid latent heat absorption electric induction heater for raising the temperature of a fluid supplied to a fluid-driven turbine in a turbine-driven electric power generation system, the fluid latent heat absorption electric induction heater comprising:

a heater vessel having at least one susceptor disposed around the interior of a longitudinal wall of the heater vessel;

at least one inductor surrounding the exterior of the longitudinal wall of the heater vessel;

a fluid inlet opening for a supply of the fluid in a low temperature liquid state, the fluid inlet opening disposed in an entry end wall of the heater vessel, the fluid inlet opening axially oriented along the length of the heater vessel and in fluid communication with a central entry fluid passage interior to the heater vessel, the central entry fluid passage extending longitudinally along the interior of the heater vessel from the fluid inlet opening to the interior of a fluid diverter wall of the heater vessel;

a plurality of interior opposing-end-interconnected annular fluid flow channels disposed radially around the central entry fluid passage and arranged to move the fluid from the central entry fluid passage in a longitudinal serpentine flow path between the interior of the fluid diverter wall and the interior of the entry end wall to an outer annual fluid flow channel adjacent to the at least one susceptor; and an outlet plenum in fluid communication with the outer annual fluid flow channel and located adjacent to the exterior of the fluid diverter wall to provide an outlet supply of the fluid in a high temperature liquid state for fluid change state processing to drive the fluid-driven turbine.

18. The fluid latent heat absorption electric induction heater of claim 17 further comprising one or more alternating current power sources having a power source output connected to the at least one inductor, the power source output having a susceptor eddy current frequency to induce eddy currents in the at least one susceptor.

19. A method of raising the temperature of a fluid in a process for driving a fluid-driven turbine in a turbine-driven electric power generation system with a fluid latent heat absorption electric induction heater, the method comprising:

supplying the fluid at a low temperature liquid state to an inlet opening of the fluid latent heat absorption electric induction heater;

passing the fluid sequentially through a central entry fluid passage; a plurality of interior opposing-end-interconnected annular fluid flow channels in a serpentine flow path along the longitudinal length of the fluid latent heat absorption electric induction heater; and an outer annular fluid flow channel adjacent to at least one susceptor disposed adjacent to the interior of a longitudinal wall of the fluid latent heat absorption electric induction heater;

supplying an alternating current to at least one inductor at least partially surrounding the exterior of the longitudinal wall to induce eddy current heating in the at least one susceptor;

transferring susceptor eddy current heat from the at least one susceptor to the fluid passing through the central entry fluid passage, the plurality of interior opposing-end-interconnected annular fluid flow channels, and the outer annular fluid flow channel; and supplying the fluid at a high temperature liquid state from the outer annular fluid flow channel to an outlet plenum of the fluid latent heat absorption electric heater for fluid change state processing to drive the fluid-driven turbine.

20. The method of claim 19 further comprising controlling the supply of the alternating current to the at least one inductor responsive to the temperature of the high temperature liquid state at the outlet plenum and/or the flow rate of the fluid passing through the fluid latent heat absorption electric induction heater.

* * * * *